United States Patent [19]

Schulz

[11] 4,138,525

[45] Feb. 6, 1979

[54] HIGHLY-HANDLEABLE PITCH-BASED FIBERS

[75] Inventor: David A. Schulz, Fairview Park, Ohio

[73] Assignee: Union Carbide Corporation, New York, N.Y.

[21] Appl. No.: 793,512

[22] Filed: May 4, 1977

Related U.S. Application Data

[60] Continuation of Ser. No. 657,208, Feb. 11, 1976, abandoned, which is a division of Ser. No. 562,777, Mar. 27, 1975, Pat. No. 4,014,725.

[51] Int. Cl.[2] ..... B32B 9/00; B29C 25/00; D02G 3/00

[52] U.S. Cl. ..... 428/367; 264/29.2; 264/176 F; 264/344; 423/447.1; 423/447.6; 428/401

[58] Field of Search ..... 428/367, 401; 423/447.6, 447.1; 264/29, 344, 176 F, 29.6; 156/148

[56] References Cited

U.S. PATENT DOCUMENTS

| | | | |
|---|---|---|---|
| 3,541,582 | 11/1970 | Johnson et al. | 23/209.1 |
| 3,595,946 | 7/1971 | Joo et al. | 264/82 X |
| 3,629,379 | 12/1971 | Otani | 423/447.5 |
| 3,702,054 | 11/1972 | Araki et al. | 423/447.6 |
| 3,716,607 | 2/1973 | Otani et al. | 264/29.6 |
| 3,787,541 | 1/1974 | Grindstaff et al. | 423/447.1 |
| 3,919,387 | 11/1975 | Singer | 264/344 |
| 3,943,213 | 3/1976 | Whittaker | 264/29 |
| 3,974,264 | 8/1976 | McHenry | 423/447.6 |
| 4,005,183 | 1/1977 | Singer | 423/447.2 |
| 4,016,247 | 4/1977 | Otani et al. | 423/447.6 |
| 4,032,430 | 6/1977 | Lewis | 423/447.1 |

FOREIGN PATENT DOCUMENTS

| | | | |
|---|---|---|---|
| 1071400 | 9/1964 | United Kingdom | 423/447.6 |

OTHER PUBLICATIONS

Otani, S., "On the Carbon Fiber from the Molten Pyrolysis Products", Carbon, vol. 3, pp. 31–38, 1965.

Bacon, R., Pallozzi, A. A., Slosarik, S. E., "Carbon Fiber", Modern Plastics, pp. 608–610, 1966.

*Primary Examiner*—Lorraine T. Kendell

*Attorney, Agent, or Firm*—John S. Piscitello

[57] ABSTRACT

Fibers having a high degree of flexibility and handleability are produced by oxidizing fibers spun from a carbonaceous pitch which has been transformed, in part, to a liquid crystal or so-called "mesophase" state to an oxygen content of from 17 per cent by weight to 30 per cent by weight. Because of their strength and handleability, these highly-oxidized fibers can be easily processed at high speeds by means of conventional yarn-transport systems, and readily woven or knit into cloth. Such cloth may then be heat treated to produce carbon or graphite cloth.

24 Claims, No Drawings

HIGHLY-HANDLEABLE PITCH-BASED FIBERS

This application is a continuation of our prior U.S. application Ser. No. 657,208, filing date Feb. 11, 1976, and now abandoned, which is a division of application Ser. No. 562,777, filing date Mar. 27, 1975, now U.S. Pat. No. 4,014,725.

BACKGROUND OF THE INVENTION

1. Field of the Invention

This invention relates to highly-oxidized pitch fibers having a high degree of flexibility and handleability which can be easily processed to produce carbon or graphite fibers, or woven or knit to produce a fabric which in turn may be heat treated to produce a carbon or graphite cloth.

2. Description of the Prior Art

The production of carbon and graphite fibers from pitch is well known in the art. Such fibers are usually produced by spinning a fiber from the pitch, thermosetting the fiber so produced by heating the fiber in an oxygen-containing atmosphere for a time sufficient to render it infusible, and then heating the infusible fiber to a carbonizing or graphitizing temperature in an inert atmosphere. While the carbonized or graphitized fibers produced in this manner are characterized by high strength, the as-spun and oxidized fibers have a very low strength. For this reason, such fibers are difficult to work with and considerable care must be exercised in processing such fibers to carbon and graphite to avoid breakage of the fibers.

Because of the low strength of the as-spun and oxidized fibers, it is customary to first carbonize or graphitize such fibers in order to improve their strength before attempting to weave or knit them into a cloth. However, while the carbonized and graphitized fibers have high strength, they also are characterized by high modulus which makes them difficult to work with because of their brittleness.

SUMMARY OF THE INVENTION

In accordance with the present invention, it has now been discovered that the tensile strength and handleability of fibers spun from a carbonaceous pitch which has been transformed, in part, to a liquid crystal or so-called "mesophase" state can be significantly improved by oxidizing the fibers to an oxygen content of from 17 per cent by weight to 30 per cent by weight, preferably from 18 per cent by weight to 22 per cent by weight.

While those skilled in the art initially sought to limit oxidation of pitch fibers to the minimum amount required to thermoset them in the belief that excessive oxidation would reduce the strength of the carbonized and graphitized fibers produced therefrom, it has now been discovered, quite surprisingly, that not only does oxidation to the high level stated above greatly increase the strength of the spun filament, but also, that it has no deleterious effect on the strength of the carbonized or graphitized fibers produced therefrom.

Because of their greater strength and handleability, the highly-oxidized fibers of the present invention are less subject to breakage and damage during subsequent thermal processing. This allows such fibers to be processed at high speeds by means of conventional yarn-transport systems where the fibers are subject to higher tensions and rougher treatment than the lower-oxidized fibers are capable of withstanding. Thus, such fibers can be rapidly transported through eyelets, over pulleys, through furnaces, and wound at high speeds while the lower-oxidized fibers cannot. In addition, the high handleability of these fibers allows them to be utilized in textile-type processes, such as weaving or knitting, where demanding high-speed operations limit the use of the more fragile lower-oxidized fibers. The cloth produced from these processes may, of course, then be further processed to produce carbon or graphite cloth by further heat treatment, thereby eliminating the difficulty of weaving or knitting cloth from fibers which have been stiffened to a high modulus by such thermal processing.

DESCRIPTION OF THE PREFERRED EMBODIMENTS

While carbonaceous fibers can be spun from non-mesophase pitches, only mesophase pitches are employed in the present invention because of their ability to produce highly-oriented fibers which can be thermoset to produce a highly flexible, handleable fiber which can be further processed to produce high modulus, high strength carbon and graphite fibers. Mesophase pitches are pitches which have been transformed, in whole or in part, to a liquid crystal or so-called "mesophase" state. Such pitches by nature contain highly oriented molecules, and when these pitches are spun into fibers, the pitch molecules are preferentially aligned by the spinning process along the longitudinal axis of the fiber to produce a highly oriented fiber.

Mesophase pitches can be produced in accordance with known techniques by heating a natural or synthetic carbonaceous pitch having an aromatic base in an inert atmosphere at a temperature of above about 350° C. for a time sufficient to produce the desired quantity of mesophase. When such a pitch is heated in this manner under quiescent conditions, either at constant temperature or with gradually increasing temperature, small insoluble liquid spheres begin to appear in the pitch which gradually increase in size as heating is continued. When examined by electron diffraction and polarized light techniques, these spheres are shown to consist of layers of oriented molecules aligned in the same direction. As these spheres continue to grow in size as heating is continued, they come in contact with one another and gradually coalesce with each other to produce larger masses of aligned layers. As coalescence continues, domains of aligned molecules much larger than those of the original spheres are formed. These domains come together to form a bulk mesophase wherein the transition from one oriented domain to another sometimes occurs smoothly and continuously through gradually curving lamellae and sometimes through more sharply curving lamellae. The differences in orientation between the domains create a complex array of polarized light extinction contours in the bulk mesophase corresponding to various types of linear discontinuity in molecular alignment. The ultimate size of the oriented domains produced is dependent upon the viscosity, and the rate of increase of the viscosity, of the mesophase from which they are formed, which, in turn are dependent upon the particular pitch and the heating rate. In certain pitches, domains having sizes in excess of two hundred microns and as large as several thousand microns are produced. In other pitches, the viscosity of the mesophase is such that only limited coalescence and structural rearrangement of layers occur, so that the ultimate domain size does not exceed one hundred microns.

The highly oriented, optically anisotropic, insoluble material produced by treating pitches in this manner has been given the term "mesophase", and pitches containing such material are known as "mesophase pitches". Such pitches, when heated above their softening points, are mixtures of two immiscible liquids, one the optically anisotropic, oriented mesophase portion, and the other the isotropic non-mesophase portion. The term "mesophase" is derived from the Greek "mesos" or "intermediate" and indicates the pseudo-crystalline nature of this highly-oriented, optically anisotropic material.

Carbonaceous pitches having a mesophase content of from about 40 per cent by weight to about 90 per cent by weight are suitable for producing the highly-oriented carbonaceous fibers capable of being thermoset to produce the highly-flexible, handleable fibers of the present invention. In order to obtain the desired fibers from such pitch, however, the mesophase contained therein must, under quiescent conditions, form a homogeneous bulk mesophase having large coalesced domains, i.e., domains of aligned molecules in excess of two hundred microns. Pitches which form stringy bulk mesophase under quiescent conditions, having small oriented domains, rather than large coalesced domains, are unsuitable. Such pitches form mesophase having a high viscosity which undergoes only limited coalescence, insufficient to produce large coalesced domains having sizes in excess of two hundred microns. Instead, small oriented domains of mesophase agglomerate to produce clumps or stringy masses wherein the ultimate domain size does not exceed one hundred microns. Certain pitches which polymerize very rapidly are of this type. Likewise, pitches which do not form a homogeneous bulk mesophase are unsuitable. The latter phenomenon is caused by the presence of infusible solids (which are either present in the original pitch or which develop on heating) which are enveloped by the coalescing mesophase and serve to interrupt the homogeneity and uniformity of the coalesced domains, and the boundaries between them.

Another requirement is that the pitch be nonthixotropic under the conditions employed in the spinning of the pitch into fibers, i.e., it must exhibit a Newtonian or plastic flow behavior so that the flow is uniform and well behaved. When such pitches are heated to a temperature where they exhibit a viscosity of from about 10 poises to about 200 poises, uniform fibers may be readily spun therefrom. Pitches, on the other hand, which do not exhibit Newtonian or plastic flow behavior at the temperature of spinning, do not permit uniform fibers to be spun therefrom.

Carbonaceous pitches having a mesophase content of from about 40 per cent by weight to about 90 per cent by weight can be produced in accordance with known techniques, as aforesaid, by heating a natural or synthetic carbonaceous pitch having an aromatic base in an inert atmosphere at a temperature above about 350° C. for a time sufficient to produce the desired quantity of mesophase. By an inert atmosphere is meant an atmosphere which does not react with the pitch under the heating conditions employed, such as nitrogen, argon, xenon, helium, and the like. The heating period required to produce the desired mesophase content varies with the particular pitch and temperature employed, with longer heating periods required at lower temperatures than at higher temperatures. At 350° C., the minimum temperature generally required to produce mesophase, at least one week of heating is usually necessary to produce a mesophase content of about 40 per cent. At temperatures of from about 400° C. to 450° C., conversion to mesophase proceeds more rapidly, and a 50 per cent mesophase content can usually be produced at such temperatures within about 1–40 hours, Such temperatures are preferred for this reason. Temperatures above about 500° C. are undesirable, and heating at this temperature should not be employed for more than about 5 minutes to avoid conversion of the pitch to coke.

The degree to which the pitch has been converted to mesophase can readily be determined by polarized light microscopy and solubility examinations. Except for certain non-mesophase insolubles present in the original pitch or which, in some instances, deveop on heating, the non-mesophase portion of the pitch is readily soluble in organic solvents such as quinoline and pyridine, while the mesophase portion is essentially insoluble. (1) In the case of pitches which do not develop non-mesophase insolubles when heated, the insoluble content of the heat-treated pitch over and above the insoluble content of the pitch before it has been heat-treated corresponds essentially to the mesophase content. (2) In the case of pitches which do develop non-mesophase insolubles when heated, the insoluble content of the heat-treated pitch over and above the insoluble content of the pitch before it has been heat treated is not solely due to the conversion of the pitch to mesophase, but also represents non-mesophase insolubles which are produced along with the mesophase during the heat treatment. Pitches which contain infusible non-mesophase insolubles (either present in the original pitch or developed by heating) in amounts sufficient to prevent the development of homogeneous bulk mesophase are unsuitable for producing highly-oriented carbonaceous fibers useful in the present invention, as noted above. Generally, pitches which contain in excess of about 2 per cent by weight of such infusible materials are unsuitable. The presence or absence of such homogeneous bulk mesophase regions, as well as the presence or absence of infusible non-mesophase insolubles, can be visually observed by polarized light microscopy examination of the pitch (see, e.g., Brooks, J. D., and Taylor, G. H., "The Formation of Some Graphitizing Carbons," *Chemistry and Physics of Carbon,* Vol. 4, Marcel Dekker, Inc., New York, 1968, pp. 243–268; and Dubois, J., Agache, C., and White, J. L., "The Carbonaceous Mesophase Formed in the Pyrolysis of Graphitizable Organic Materials," Metallography 3, pp. 337–269, 1970). The amounts of each of these materials may also be visually estimated in this manner.

(1) The percent of quinoline insolubles (Q.I.) of a given pitch is determined by quinoline extraction at 75° C. The per cent of pyridine insolubles (P.I.) is determined by Soxhlet extraction is boiling pyridine (115° C.).

(2) The insoluble content of the untreated pitch is generally less than 1 per cent (except for certain coal tar pitches) and consists largely of coke and carbon black found in the original pitch.

Aromatic base carbonaceous pitches having a carbon content of from about 92 per cent by weight to about 96 per cent by weight and a hydrogen content of from about 4 per cent by weight to about 8 per cent by weight are generally suitable for producing mesophase pitches which can be employed to produce the fibers useful in the instant invention. Elements other than carbon and hydrogen, such as oxygen, sulfur and nitrogen, are undesirable and should not be present in excess of about 4 per cent by weight. When such extraneous elements are present in amounts of from about 0.5 per cent by weight to about 4 per cent by weight, the pitches generally have a carbon content of from about 92–95 per cent by weight, the balance being hydrogen.

Petroleum pitch, coal tar pitch and acenaphthylene pitch are preferred starting materials for producing the mesophase pitches which are employed to produce the fibers useful in the instant invention. Petroleum pitch can be derived from the thermal or catalytic cracking of petroleum fractions. Coal tar pitch is similarly obtained by the destructive distillation of coal. Both of these materials are commercially available natural pitches in which mesophase can easily be produced, and are preferred for this reason. Acenaphthylene pitch, on the other hand, is a synthetic pitch which is preferred because of its ability to produce excellent fibers. Acenaphthylene pitch can be produced by the pyrolysis of polymers of acenaphthylene as described by Edstrom et al, in U.S. Pat. No. 3,574,653.

Some pitches, such as fluoranthene pitch, polymerize very rapidly when heated and fail to develop large coalesced domains of mesophase, and are, therefore, not suitable precursor materials. Likewise, pitches having a high infusible non-mesophase insoluble content in organic solvents such as quinoline or pyridine, or those which develop a high infusible non-mesophase insoluble content when heated, should not be employed as starting materials, as explained above, because these pitches are incapable of developing the homogeneous bulk mesophase necessary to produce highly-oriented carbonaceous fibers. For this reason, pitches having an infusible quinoline-insoluble or pyridine-insoluble content of more than about 2 per cent by weight (determined as described above) should not be employed, or should be filtered to remove this material before being heated to produce mesophase. Preferably, such pitches are filtered when they contain more than about 1 per cent by weight of such infusible, insoluble material. Most petroleum pitches and synthetic pitches have a low infusible, insoluble content and can be used directly without such filtration. Most coal tar pitches, on the other hand, have a high infusible, insoluble content and require filtration before they can be employed.

As the pitch is heated at a temperature between 350° C. and 500° C. to produce mesophase, the pitch will, of course, pyrolyze to a certain extent and the composition of the pitch will be altered, depending upon the temperature, the heating time, and the composition and structure of the starting material. Generally, however, after heating a carbonaceous pitch for a time sufficient to produce a mesophase content of from about 40 per cent by weight to about 90 per cent by weight, the resulting pitch will contain a carbon content of from about 94–96 per cent by weight and a hydrogen content of from about 4–6 per cent by weight. When such pitches contain elements other than carbon and hydrogen in amounts of from about 0.5 per cent by weight to about 4 per cent by weight, the mesophase pitch will generally have a carbon content of from about 92–95 per cent by weight, the balance being hydrogen.

After the desired mesophase pitch has been prepared, it is spun into fiber by conventional techniques, e.g., by melt spinning, centrifugal spinning, blow spinning, or in any other known manner. As noted above, in order to obtain highly-oriented carbonaceous fibers capable of being thermoset to produce the highly-flexible, handleable fibers of the present invention, the pitch must, under quiescent conditions, form a homogeneous bulk mesophase having large coalesced domains, and be nonthixotropic under the conditions employed in the spinning. Further, in order to obtain uniform fibers from such pitch, the pitch should be agitated immediately prior to spinning so as to effectively intermix the immiscible mesophase and non-mesophase portions of the pitch.

The temperature at which the pitch is spun depends, of course, upon the temperature at which the pitch exhibits a suitable viscosity, and at which the higher-melting mesophase portion of the pitch can be easily deformed and oriented. Since the softening temperature of the pitch, and its viscosity at a given temperature, increases as the mesophase content of the pitch increases, the mesophase content should not be permitted to rise to a point which raises the softening point of the pitch to excessive levels. For this reason, pitches having a mesophase content of more than about 90 per cent are generally not employed. Pitches containing a mesophase content of from about 40 per cent by weight to about 90 per cent by weight, however, generally exhibit a viscosity of from about 10 poises to about 200 poises at temperatures of from about 310° C. to above about 450° C. and can be readily spun at such temperatures. Preferably, the pitch employed has a mesophase content of from about 45 per cent by weight to about 75 per cent by weight, most preferably from about 55 per cent by weight to about 75 per cent by weight, and exhibits a viscosity of from about 30 poises to about 150 poises at temperatures of from about 340° C. to about 440° c. At such viscosity and temperature, uniform fibers having diameters of from about 6 microns to about 14 microns can be easily spun. Such small diameter fibers are preferred because of their increased handleability. As previously mentioned, however, in order to obtain the desired fibers, it is important that the pitch be nonthixotropic and exhibit Newtonian or plastic flow behavior during the spinning of the fibers.

After the carbonaceous fibers have been spun, they are oxidized to an oxygen content of from 17 per cent by weight to 30 per cent by weight, preferably from 18 per cent by weight to 22 per cent by weight, by heating in an oxygen atmosphere. The oxygen atmosphere employed may be pure oxygen, nitric oxide, or any other appropriate oxidizing atmosphere. Most conveniently, air is employed as the oxidizing atmosphere.

The time required to oxidize the fibers to the desired degree will, of course, vary with such factors as the particular oxidizing atmosphere, the temperature employed, the diameter of the fibers, the particular pitch from which the fibers are prepared, and the mesophase content of such pitch. Generally, however, in excess of 60 minutes heating are required to effect the desired degree of oxidation, usually from about 120 minutes to about 240 minutes.

The temperature at which the fibers are oxidized must, of course, not exceed the temperature at which the fibers will soften or distort. The maximum temperature which can be employed will thus depend upon the particular pitch from which the fibers were spun, and the mesophase content of such pitch. The higher the mesophase content of the fiber, the higher will be its softening temperature, and the higher the temperature which can be employed to effect oxidation. At higher temperatures, of course, oxidation can be effected in less time than is possible at lower temperatures. Fibers having a lower mesophase content, on the other hand, require relatively longer heat treatment at somewhat lower temperatures to effect the desired degree of oxidation.

A minimum temperature of at least 250° C. is generally necessary to effect oxidation of the fibers. Temperatures in excess of 500° C. may cause melting and/or excessive burn-off of the fibers and should be avoided. Preferably, temperatures of from about 275° C. to about 390° C. are employed.

The oxidized fibers produced in this manner have a high degree of flexibility and handleability, a strain-to-failure of at least 5 per cent, and a tensile strength of at least 30,000 psi., usually at least 35,000 psi. These properties enable continuous fiber lengths to be easily tied in a knot, processed at high speeds by means of conventional yarn-transport systems, and readily woven or knit into cloth. Such cloth may then be processed to carbon or graphite form by further heat treatment, thereby eliminating the difficulty of weaving or knitting cloth from fibers which have been stiffened to a high modulus by such thermal treatment. When staple length fibers are produced, they may be used to produce continuous length fibers by means of conventional techniques.

After the fibers have been oxidized to the extent necessary and, if desired, woven or knit into cloth, they are heated to a carbonizing temperature so as to expel hydrogen and other volatiles. At a temperature of about 1000° C., fibers having a carbon content greater than about 98 per cent by weight are obtained. At temperatures in excess of 1500° C., the fibers are substantially completely carbonized. Such heating should be conducted in an oxygen-free atmosphere, such as the inert atmospheres described above, to prevent further oxidation of the fibers.

Usually, carbonization is effected at a temperature of from about 1000° C. to about 2500° C., preferably from about 1400° C. to about 1700° C. Generally, residence times of no more than about 60 minutes are employed. While more extended heating times can be employed with good results, such residence times are uneconomical and, as a practical matter, there is no advantage in employing such long periods. In order to ensure that the rate of weight loss of the fibers does not become so excessive as to disrupt the fiber structure, it is preferred to gradually heat the fibers to their final carbonization temperature.

If desired, the carbonized fibers may be further heated in an inert atmosphere, as described hereinbefore, to a graphitizing temperature in a range of from above about 2500° C. to about 3300° C., preferably from about 2800° C. to about 3000°C. A residence time of about 1 minute is satisfactory, although both shorter and longer times may be employed, e.g., from about 1 second to about 5 minutes, or longer. Residence times longer than 5 minutes are uneconomical and unnecessary, but may be employed if desired.

The following example is set forth for purposes of illustration so that those skilled in the art may better understand the invention. It should be understood that it is exemplary only, and should not be construed as limiting the invention in any manner. Tensile strengths referred to in the examples and throughout the specification, unless otherwise indicated, were measured on 10 cm. length unidirectional fiber-epoxy composites. Young's modulus was measured on 2.0 cm. lengths of individual filaments unless otherwise indicated.

EXAMPLE 1

A commercial petroleum pitch was employed to produce a pitch having a mesophase content of about 56 per cent by weight. The precursor pitch had a density of 1.23 Mg./m.$^3$, a softening temperature of 120° C. and contained 0.3 per cent by weight quinoline insolubles (Q.I. was determined by quinoline extraction at 75° C.).

The mesophase pitch was produced by heating the precursor petroleum pitch at a temperature of about 400° C. for about 19 hours under flowing nitrogen. The pitch was continuously stirred during this time and nitrogen gas was continuously bubbled through the pitch. After heating, the pitch exhibited a softening point of 341° C. and contained 56.6 per cent by weight pyridine insolubles, indicating that the pitch had a mesophase content of close to 56 per cent.

A portion of the pitch produced in this manner was then melt spun into fibers at a rate of 325 meters per minute through a 240 hole spinnerette (0.07 mm. diameter holes) at a temperature of 385° C. The filaments passed through a nitrogen atmosphere as they left the spinnerette and were then taken up by a reel. A considerable quantity of fiber 9–12 microns in diameter was produced in this manner.

A portion of the spun filaments were placed in a stainless steel wire mesh tray and heated in a forced-air convection oven to a temperature of 315° C. over a period of 45 minutes. This procedure was repeated a number of times with different portions of the spun filaments, except that varying hold times at 315° C. were employed with each successive portion so as to vary the exposure time of each portion to the oxidizing atmosphere and the resulting oxygen content of the fibers of each lot. The oxygen content, tensile strength and modulus of the fibers produced in each run was then determined. The results of these experiments are set forth in Table I below:

Table I

Mechanical Properties of Thermoset Mesophase Pitch Fibers as a Function of Oxygen Content

| Run No. | Hold Time at 315° C., Min. | Composition, % 0 | C | H | Tensile Strength, kpsi. | Young's Modulus, Mpsi. | Strain to Failure, % |
|---|---|---|---|---|---|---|---|
| 1 | 0 | 8.5 | 89.4 | 3.3 | — | 0.65 | — |
| 2 | 15 | 13.3 | 85.0 | 3.0 | 17 | 0.80 | 2.1 |
| 3 | 30 | 14.8 | 83.3 | 2.7 | 20 | 0.71 | 2.8 |
| 4 | 45 | 15.4 | 81.2 | 2.6 | 21 | 0.66 | 3.2 |
| 5 | 60 | 16.2 | 80.2 | 2.6 | 27 | 0.52 | 5.2 |
| 6 | 90 | 17.4 | 79.4 | 2.5 | 31 | 0.66 | 4.7 |
| 7 | 180 | 18.7 | 78.3 | 2.2 | 37 | 0.63 | 5.6 |
| 8 | 240 | 20.3 | 77.3 | 2.2 | 36 | 0.72 | 5.0 |
| 9 | 1160 | 26.3 | 71.1 | 1.8 | 33 | — | — |

Samples from Runs Nos. 7 and 8 were found to be highly handleable and could be woven into a cloth without difficulty. This cloth could be carbonized or graphitized by further heat treatment.

What is claimed is:

1. A process for producing pitch fiber having a high degree of flexibility and handleability which comprises spinning a carbonaceous fiber from a nonthixotropic carbonaceous pitch having a mesophase content of from 40 per cent by weight to 90 per cent by weight which under quiescent conditions forms a homogeneous bulk mesophase having large coalesced domains; and heating the spun fiber in an oxygen-containing atmosphere at a temperature of from 250° C. to 500° C. for a time sufficient to oxidize the fiber to an oxygen content of from 17 per cent by weight to 30 per cent by weight to produce a fiber having a tensile strength of at least 30,000 psi. and a strain-to-failure of at least 5 per cent.

2. A process as in claim 1 wherein the carbonaceous fiber which is spun from the carbonaceous pitch has a diameter of from 6 microns to 14 microns.

3. A process as in claim 1 wherein the spun fiber is oxidized to an oxygen content of from 18 per cent by weight to 22 per cent by weight.

4. A process as in claim 3 wherein the carbonaceous fiber which is spun from the carbonaceous pitch has a diameter of from 6 microns to 14 microns.

5. A process as in claim 1 wherein the oxygen-containing atmosphere is air and the spun fiber is heated in said atmosphere at a temperature of from 275° C. to 390° C.

6. A process as in claim 5 wherein the carbonaceous fiber which is spun from the carbonaceous pitch has a diameter of from 6 microns to 14 microns.

7. A process as in claim 5 wherein the spun fiber is oxidized to an oxygen content of from 18 per cent by weight to 22 per cent by weight.

8. A process as in claim 7 wherein the carbonaceous fiber which is spun from the carbonaceous pitch has a diameter of from 6 microns to 14 microns.

9. In a process for producing carbon fiber which comprises spinning a carbonaceous fiber from a nonthixotropic carbonaceous pitch having a mesophase content of from 40 per cent by weight to 90 per cent by weight which under quiescent conditions forms a homogeneous bulk mesophase having large coalesced domains; heating the spun fiber in an oxygen-containing atmosphere at a temperature of from 250° C. to 500° C. for a time sufficient to render it infusible; and carbonizing the infusible fiber so produced by heating in an inert atmosphere; the improvement which comprises oxidizing the spun fiber to an oxygen content of from 17 per cent by weight to 30 per cent by weight to produce a fiber having a tensile strength of at least 30,000 psi. and a strain-to-failure of at least 5 per cent.

10. A process as in claim 9 wherein the carbonaceous fiber which is spun from the carbonaceous pitch has a diameter of from 6 microns to 14 microns.

11. A process as in claim 9 wherein the spun fiber is oxidized to an oxygen content of from 18 per cent by weight to 22 per cent by weight.

12. A process as in claim 11 wherein the carbonaceous fiber which is spun from the carbonaceous pitch has a diameter of from 6 microns to 14 microns.

13. A process as in claim 9 wherein the oxygen-containing atmosphere is air and the spun fiber is heated in said atmosphere to a temperature of from 275° C. to 390° C.

14. A process as in claim 13 wherein the carbonaceous fiber which is spun from the carbonaceous pitch has a diameter of from 6 microns to 14 microns.

15. A process as in claim 13 wherein the spun fiber is oxidized to an oxygen content of from 18 per cent by weight to 22 per cent by weight.

16. A process as in claim 15 wherein the carbonaceous fiber which is spun from the carbonaceous pitch has a diameter of from 6 microns to 14 microns.

17. Carbonaceous fiber prepared by oxidizing a pitch fiber having a mesophase content of from 40 per cent by weight to 90 per cent by weight to an oxygen content of from 17 per cent by weight to 30 per cent by weight, said fiber having a tensile strength of at least 30,000 psi. and a strain-to-failure of at least 5 per cent.

18. A fiber as in claim 17 having a diameter of from 6 microns to 14 microns.

19. A fiber as in claim 17 having an oxygen content of from 18 per cent by weight to 22 per cent by weight.

20. A fiber as in claim 19 having a diameter of from 6 microns to 14 microns.

21. A fiber as in claim 17 having a tensile strength of at least 35,000 psi.

22. A fiber as in claim 21 having a diameter of from 6 microns to 14 microns.

23. A fiber as in claim 21 having an oxygen content of from 18 per cent by weight to 22 per cent by weight.

24. A fiber as in claim 23 having a diameter of from 6 microns to 14 microns.

* * * * *

UNITED STATES PATENT OFFICE

CERTIFICATE OF CORRECTION

Patent No. 4,138,525 Dated February 6, 1979

Inventor(s) David A. Schulz

It is certified that error appears in the above-identified patent and that said Letters Patent are hereby corrected as shown below:

Column 4, line 5, the comma (,) after "hours" should be a period (.).

Column 4, line 14, "deveop" should read -- develop --.

Column 4, line 49, "337-269" should read -- 337-369 --.

Column 5, line 16, the comma (,) after "al" should be a period (.).

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*